United States Patent [19]

Ishikawa

[11] 4,099,286

[45] Jul. 11, 1978

[54] CLEANERS FOR CHALK ERASERS

[76] Inventor: Soji Ishikawa, 1-22, Chohai-cho, Minami-ku, Nagoya-shi, Aichi-ken, Japan

[21] Appl. No.: 773,130

[22] Filed: Feb. 28, 1977

[30] Foreign Application Priority Data

Feb. 27, 1976 [JP] Japan ..... 51-23791

[51] Int. Cl.[2] ..... A46B 17/06; B43L 21/00

[52] U.S. Cl. ..... 15/142; 220/1 T

[58] Field of Search ..... 15/89, 104 R, 142, 221, 15/257 R, 310, DIG. 9; 220/1 T

[56] References Cited

U.S. PATENT DOCUMENTS

| | | | |
|---|---|---|---|
| 628,615 | 7/1899 | Smith | 15/89 |
| 1,013,775 | 1/1912 | Hoffman | 220/1 T X |
| 1,521,398 | 12/1924 | Seyfferth | 220/1 T UX |
| 1,667,431 | 4/1928 | Meyers et al. | 15/142 |
| 1,892,494 | 12/1932 | Reynolds | 15/142 |
| 1,934,144 | 11/1933 | Reiser | 15/142 UX |
| 2,192,896 | 3/1940 | Corson | 15/142 |
| 3,805,312 | 4/1974 | Wu | 15/142 |
| 3,918,117 | 11/1975 | Plante | 15/21 D |

FOREIGN PATENT DOCUMENTS

| | | | |
|---|---|---|---|
| 2,234,559 | 3/1974 | Fed. Rep. of Germany | 220/1 T |
| 345,720 | 5/1960 | Switzerland | 15/142 |

*Primary Examiner*—Daniel Blum

*Attorney, Agent, or Firm*—Blair, Brown & Kreten

[57] ABSTRACT

A cleaner for removing chalk powder from a chalk eraser, comprising an upper case having an aperture through which the chalk eraser is inserted, a lower case removably connected with the upper case for collecting chalk powder and a cleaning plate interposed between the upper and lower cases. The cleaning plate has a plurality of ridges and slots against which the chalk eraser is struck. The upper case has a blocking member closing its aperture and which can be spread open to insert a chalk eraser therethrough. Chalk powder falls into the lower case through the slots and accumulates in the lower case.

5 Claims, 3 Drawing Figures

CLEANERS FOR CHALK ERASERS

BACKGROUND OF THE INVENTION

The present invention relates to cleaners for chalk erasers used in schoolrooms and offices.

Chalk powder is usually removed from a chalk eraser by striking the eraser with an appropriate stick or by striking two erasers against each other to scatter chalk powder in the air.

Since chalk powder is of minute particles, it scatters widely in the air and tends to be inhaled in pupils' respiratory organs and injure their health. Moreover, it tends to make the environment so powdery that additional cleaning is necessary. Further, cleaning a chalk eraser is so troublesome a job that one is often compelled to continue using an eraser carrying much chalk powder thereon, especially in schoolrooms in which chalk erasers are frequently used.

It is hard to employ electric-powered cleaners or cleaners of complex construction in view of the difficulty in their upkeep and maintenance, particularly in schools in backcountries. Thus, it is seriously desired to provide a cleaner for a chalk eraser which is of a simple construction and which is easy and economical to use.

SUMMARY OF THE INVENTION

The object of the present invention is to provide a new and improved cleaner for a chalk eraser which can be handily utilized, for example, in schoolrooms where chalk erasers are frequently used, and which permits easy disposal of chalk powder.

Another object of the present invention is to provide a cleaner for a chalk eraser which can collect chalk powder from the eraser without scattering the same in the open atmosphere and contaminating the environment.

Still another object of the present invention is to provide a chalk eraser cleaner of a simple construction which is easily worked by hand, reasonable in price and upkeep expenses, safe in handling and effective in function.

In accordance with the present invention, there is provided a cleaner for a chalk eraser comprising an upper case having on one side an aperture through which the chalk eraser held by hand is put into the case, a blocking member of elastic material covering said aperture and which can be spread open to insert the chalk eraser therethrough, a lower case removably connected with said upper case and a cleaning plate interposed between said upper and lower cases and provided with a plurality of transversely extending, alternately arranged ridges and slots.

The cleaner of the present invention can be employed, for example, in schools, particularly in backcountries, since it is of simple and easily dismountable construction, comprising upper and lower cases and the cleaning plate interposed therebetween, reasonable in price and easy to use by hand.

The cleaner of the present invention can keep the environment clean since the blocking member substantially fully closes the open area of the aperture through which the chalk eraser is inserted, to prevent chalk powder from scattering out of the cleaner.

Further, the cleaner of the present invention is safe in handling since it is worked by hand, effective in removing chalk powder since the chalk eraser is struck and rubbed against the cleaning plate and the lower case can be detached easily to dispose of collected chalk powder.

The invention will now be described in further detail by way of example with reference to the accompanying drawings, in which.

Figure 1:
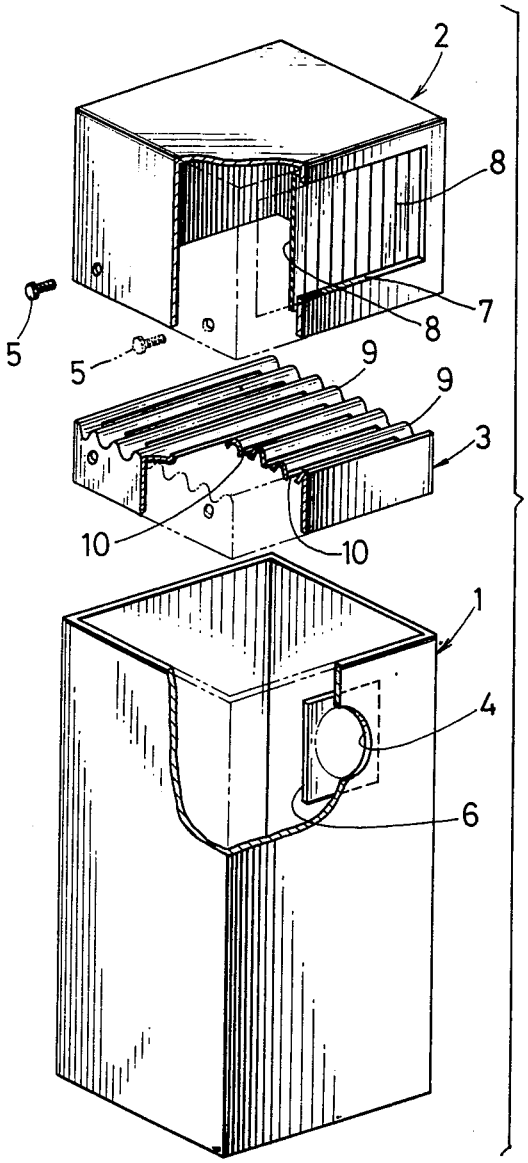
FIG. 1 is an exploded perspective view, partly broken away, of a preferred embodiment of this invention.

Referring now to FIG. 1 of the drawings, there is shown a cleaner for a chalk eraser in the form of a wastebasket according to a preferred embodiment of this invention. The cleaner of this invention is an upright, self-supporting structure comprising a lower case 1, an upper case 2 and a cleaning plate 3 interposed therebetween.

The lower case 1 is a box having an open top, and which is so large that it can contain a certain volume of wastepaper, too. On the front side of the lower case 1, there is provided an opening 4 through which wastepaper is thrown into the case 1. A flap 6 is secured to the inner wall of the lower case 1 at the upper end thereof, and while normally closing the opening 4, it can be pushed open inwardly when wastepaper is thrown into the lower case 1. The flap 6 may be made of flexible material such as cloth or a board hinged at its upper end, preferably automatically closing the opening 4 in a normal condition.

Figure 2:
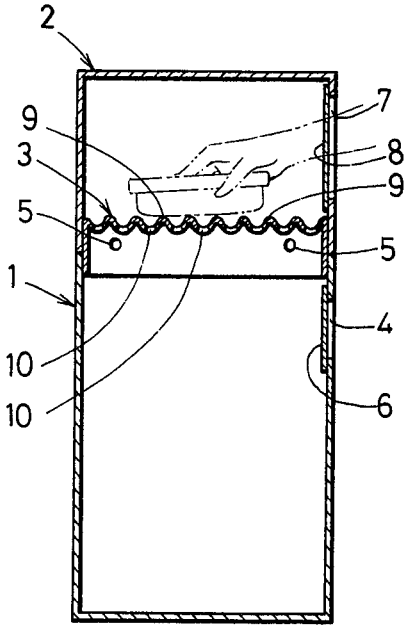
FIG. 2 is a longitudinal sectional view of the device shown in FIG. 1 in its integrally assembled condition.

The cleaning plate 3 is provided to clean the wiping surface of a chalk eraser as shown in broken lines in FIG. 2, and the upper surface of the cleaning plate 3 is provided with a plurality of alternately arranged, transversely extending ridges 9 and slots 10. The lower half of the cleaning plate 3 is removably fitted in the upper end of the lower case 1.

The upper case 2 is a box having an open bottom and which is sufficiently large to permit both vertical and horizontal movement of a chalk eraser therein. The lower end of the upper case 2 is removably fitted over the upper half of the cleaning plate 3, and secured thereto by screws 5. In the center of the front side of the upper case 2, there is formed an aperture 7 through which the user can put his hand holding a chalk eraser into the case 2, and on the inner wall of the upper case 2, there is provided a blocking member 8 covering the aperture 7.

The blocking or closing member 8 may be made of a plurality of strings or bands of flexible and appropriately heavy material, for example, rubber. The blocking member 9 may be suspended from the inner upper edge of the aperture 7 or bonded to the inner upper and lower edges thereof. Alternatively, the aperture 7 may be covered with a sheet of cloth having on its center an opening hemmed by an elastic cord which can be spread open to the extent that a chalk eraser held by hand can be put therethrough into the case 2.

The cleaner of this invention constructed as described above can advantageously be set near a blackboard or anywhere else as desired.

A chalk eraser from which chalk powder is to be removed is held by the hand of the user with its wiping surface down and put into the upper case 2 through the aperture 7 (see FIG. 2) by spreading the blocking member 8 open. After the chalk eraser is put into the upper case 2, the blocking member 8 substantially fully closes the open area of the aperture 7 by its own weight or by its elasticity.

Then the chalk eraser is struck and rubbed against the ridges 9 on the upper surface of the cleaning plate 3, and chalk powder falls into the lower case 1 through the slots 10. The chalk powder temporarily scattering in the upper case may not fly about beyond the blocking member 8, and eventually falls into the lower case 1 through the slots 10. Since the opening 4 in the front side of the lower case 1 is closed by the flap 6, no chalk powder scatters out of the opening 4. Thus, the cleaner of this invention can easily and safely be utilized by small children.

Wastepaper can be thrown into the lower case 1 through the opening 4 by pushing the flap 6 open. Since the chalk powder collected in the lower case 1 accumulates with wastepaper, chalk powder can conveniently be disposed of with wastepaper. Further, since the upper case 2 and the cleaning plate 3 are securely fitted with each other and can be raised together, the lower case 1 can easily be detached to dispose of the chalk powder and the wastepaper contained in the lower case 1. The inner wall of the lower case 1 has an evenly finished surface, so that the chalk powder and the wastepaper can easily be thrown out by tilting the lower case 1.

Figure 3:
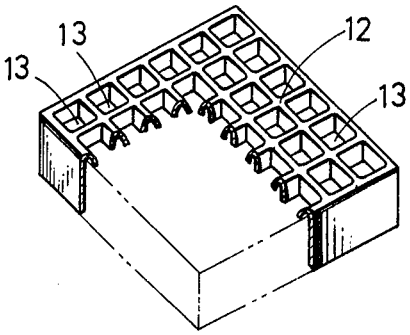
FIG. 3 is a partially cut away perspective view of another embodiment of the cleaning plate.

As shown in FIG. 3, the cleaning plate 3 may alternatively be of the grid-shaped construction formed by ridges 12 and square slots 13. Further, the lower case 1 may be smaller sized to eliminate the opening 4 and the flap 6, in case the device is intended for use solely as a cleaner for a chalk eraser.

While the invention has been described with reference to a preferred embodiment, it is to be understood that further modifications or variations may be easily made without departing from the scope of this invention which is defined by the appended claims.

What is claimed is:

1. A cleaner for a chalk eraser comprising an upper case having an open bottom and formed on one side with an aperture through which a chalk eraser is put into said upper case, a member of elastic material closing said aperture and which can be spread open to insert the chalk eraser through said aperture, a lower case having an open top and removably connected with said upper case and a cleaning plate positioned at the juncture of said upper and lower cases and provided with a plurality of alternately arranged ridges and slots opening into said lower case and wherein said lower case is formed on one side with an opening normally closed by a depending flap through which wastepaper may be thrown into said lower case.

2. A cleaner defined in claim 1 wherein said closing member is made of a plurality of vertically extending strips having upper and lower ends maintained in intimate contact with the peripheral edge of said aperture.

3. A cleaner defined in claim 2 wherein said ridges extend transversely of said cleaning plate in parallel with one another and said slots are elongated in the direction of said ridges.

4. A cleaner defined in claim 2 wherein said ridges extend longitudinally and transversely of said cleaning plate to form a grid-shaped structure defining said slots as square shaped.

5. A cleaner defined in claim 2 wherein said upper and lower cases are fitted over said cleaning plate, said lower case being removable from said cleaning plate.

* * * * *